United States Patent [19]

Takenoya et al.

[11] Patent Number: 4,519,328

[45] Date of Patent: May 28, 1985

[54] ELECTRONIC SEWING MACHINE WITH CONTROL DETECTING DEVICE

[75] Inventors: Hideaki Takenoya; Eiichi Shomura, both of Tokyo, Japan

[73] Assignee: Janome Sewing Machine Co., Ltd., Tokyo, Japan

[21] Appl. No.: 388,985

[22] Filed: Jun. 16, 1982

[30] Foreign Application Priority Data

Jun. 16, 1981 [JP] Japan ..... 56-91564

[51] Int. Cl.[3] ..... D05B 3/02

[52] U.S. Cl. ..... 112/158 E; 112/279; 112/121.12

[58] Field of Search ..... 112/275, 158 E, 279, 112/121.12, 220, 221, 277

[56] References Cited

U.S. PATENT DOCUMENTS

| | | | |
|---|---|---|---|
| 4,133,275 | 1/1979 | Herzer et al. | 112/121.12 |
| 4,183,473 | 1/1980 | Neuweiler et al. | 112/279 X |
| 4,393,795 | 7/1983 | Makabe et al. | 112/158 E |

*Primary Examiner*—Peter Nerbun

*Attorney, Agent, or Firm*—Michael J. Striker

[57] ABSTRACT

An electronic sewing machine includes at least two pulse motors, in which a control detecting device detects all individual operations of the movable members in response to a plurality of functions performed by independent driving sources, such that in each of these functions the machine operates normally. The control detecting device includes two screen interrupting elements each associated with the respective pulse motor and a single photoelectric sensor cooperating with each interrupting element for producing electric signals for operating a microcomputer of the sewing machine to set each of the pulse motors to an initial position.

4 Claims, 7 Drawing Figures

FIG_1
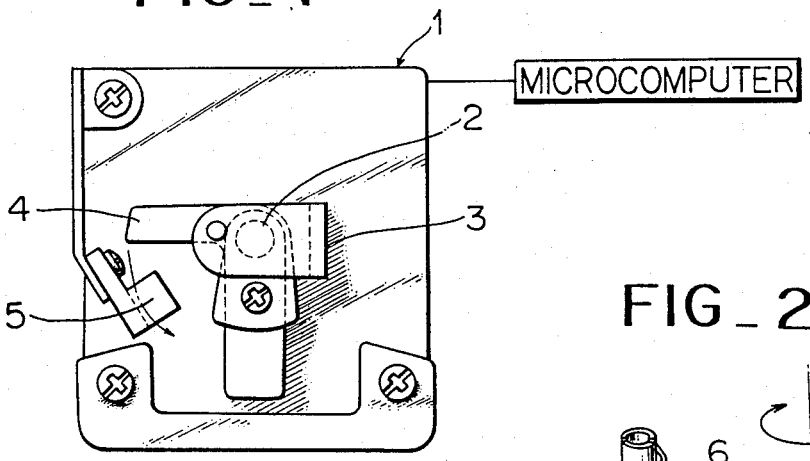
PRIOR ART
FIG_2
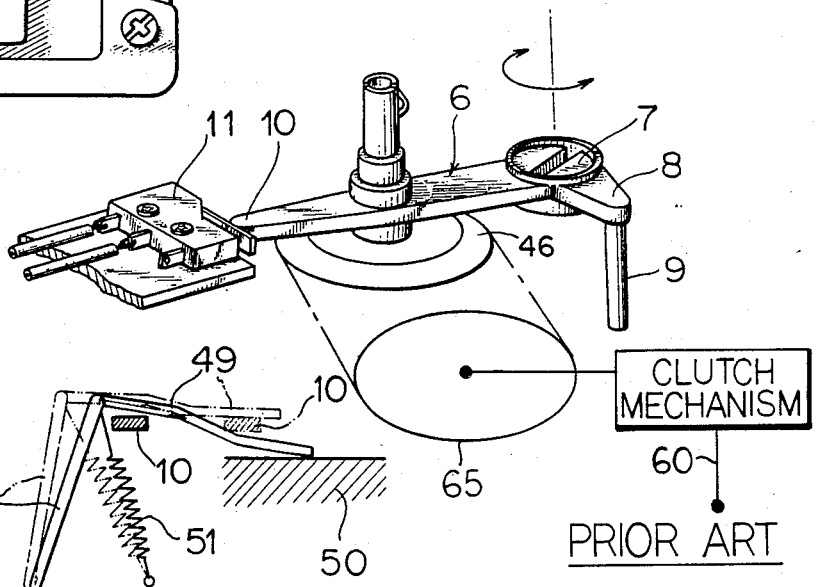
PRIOR ART
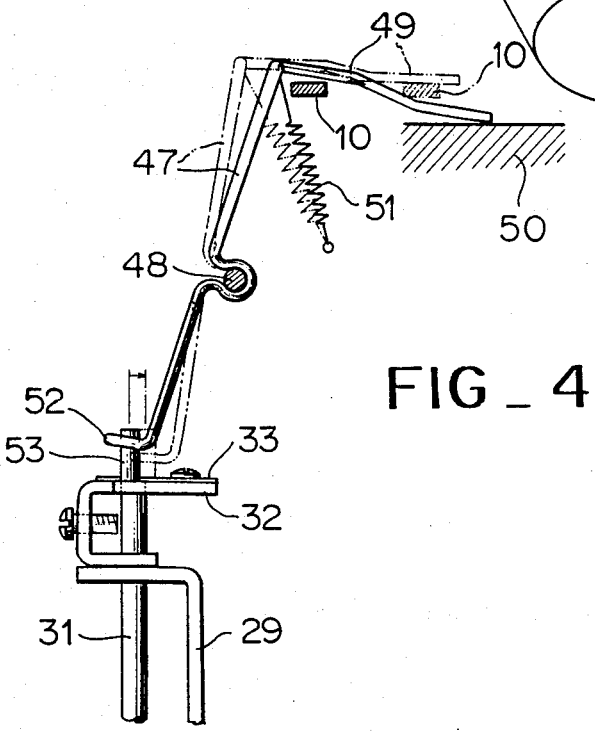
FIG_4

(1) Needle dropping position
(2) Coordinate
(3) A phase (4) B phase (5) $\bar{A}$ phase (6) $\bar{B}$ phase (7) Feed amount

FIG_7

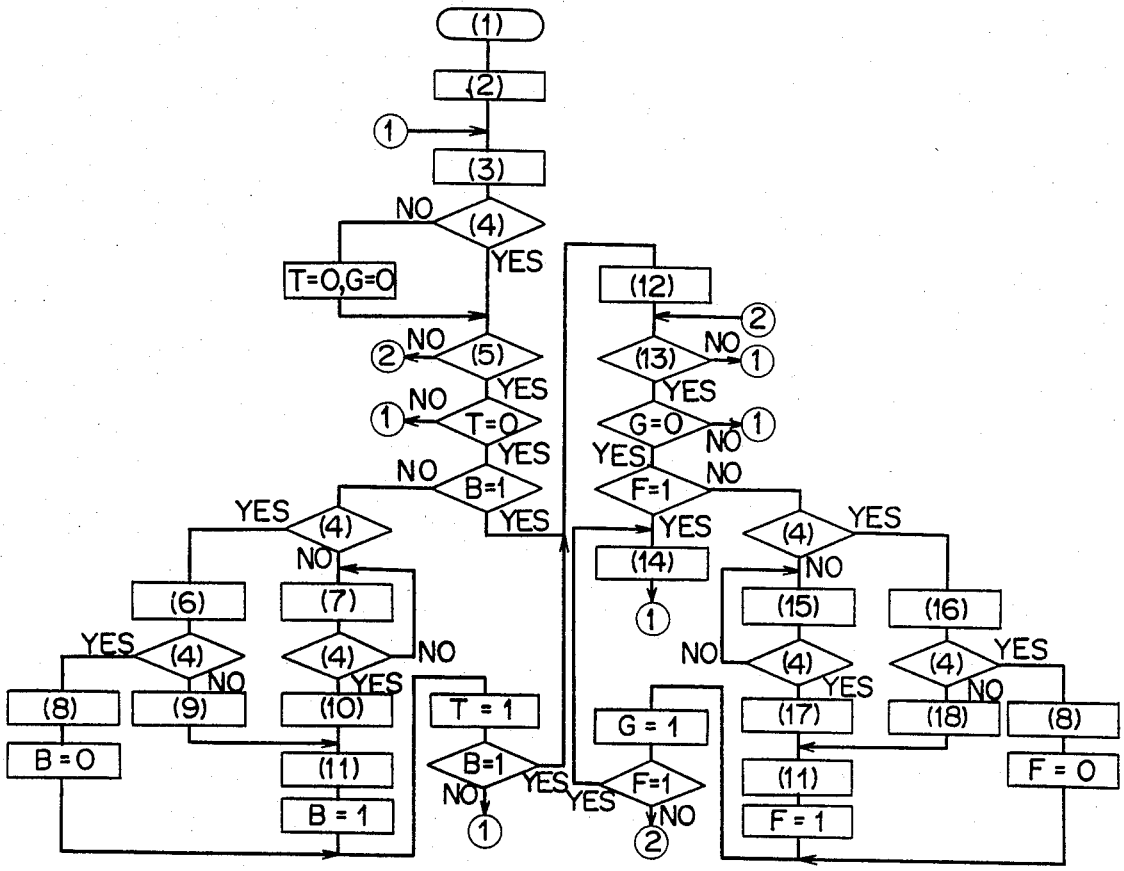

(1) Start (2) Energization of A and B phases (B=0, T=0, F=0, G=0)
(3) Reading-out of Key (4) "5" interrupting the light
(5) Amplitude phase (6) 8 steps of "1" in the clockwise direction
(7) 8 steps of "1" in the counterclockwise direction
(8) Designation of low speed (9) Amplitude coordinate of 62
(10) Amplitude coordinate of 70 (11) Designation of high speed
(12) Amplitude control (13) Feed phase
(14) Feed control (15) 8 steps of "21" in the clockwise direction
(16) 8 steps of "21" in the counterclockwise direction
(17) Feed coordinate of 4 (18) Feed coordinate of 12

ELECTRONIC SEWING MACHINE WITH CONTROL DETECTING DEVICE

BACKGROUND OF THE INVENTION

The invention relates to a computer sewing machine having two pulse motors, one for controlling the needle swinging amplitude and the other for controlling the fabric feeding amount under a predetermined program of microcomputer. More particularly, the invention relates to a computer sewing machine of Janome, in which a sensor is provided to detect an accident in operation of the sewing machine. Namely, if the drive shaft of the sewing machine is prevented from rotation for a predetermined time upon energization of the machine drive motor due to an accident such as the jamming of loop taker, the sensor detects the abnormal condition (failure in rotation of the drive shaft), and produces an electric signal. Then the microcomputer is operated with the electric signal to deenergize the machine drive motor even if the machine operator operates the controller switch of the motor to avoid the overheat of the machine drive motor. A failure in rotation of the drive shaft is caused not only by an accident but also by declutching the belt wheel from the drive shaft just when the bobbin thread winding operation is carried out. As can be seen, the bobbin thread is wound with the belt wheel which is rotated by energization of the machine drive motor while the drive shaft is left standstill. It is, however, undesirable if such a microcomputer detects failure of the drive shaft rotation and then deenergizes the machine drive motor, just as in the case of some accident. Therefore it becomes necessary in such an occasion to provide a device to produce a signal indicating that the microcomputer should not operate to deenergize the machine drive motor.

In conventional computer sewing machines using two pulse motors for controlling the needle swinging amplitude and the fabric feed amount the pulse motors are each provided with a photoelectric sensor 5 and a screening element 4 illustrated on FIG. 1 which shows together with FIG. 2 a prior art arrangement. Sensor 5 and screening element 4 are cooperated so as to determine the initial position of each pulse motor when the power source is applied to the sewing machine in the manner as described in detail in Janome U.S. Pat. No. 4,271,773. Additionally another sensor (microswitch 11) is used in relation with the bobbin thread winding device, especially in Janome computer sewing machine. The sensor 11 is operated in association with the actuating member 6 which is manually operated to bring the wheel 46 into engagement with the belt wheel of the sewing machine for winding the bobbin thread and simultaneously to cause the declutch pin 9 to declutch the belt wheel from the drive shaft of the sewing machine. The sensor 11 is operated to produce an electric signal indicating that the microcomputer should not deenergize the machine drive motor if the drive shaft is not rotated when the controller switch of the machine drive motor is operated to drive the belt wheel for winding the bobbin thread.

The conventional Janome computer sewing machine has three sensors for the two pulse motors and for the bobbin thread winding device, respectively.

SUMMARY OF THE INVENTION

It is therefore an object of the invention to reduce the three sensors of the conventional sewing machine to a single one for simplifying the structure of the sewing machine and also for reducing the cost for production of the sewing machine.

The sewing machine according to the invention includes at least two pulse motors, in which detecting devices detect in common operations of the movable members in response to a plurality of functions thereof.

BRIEF DESCRIPTION OF THE DRAWINGS

FIG. 1 shows a structure of a detector of a conventional pulse motor;

FIG. 2 shows a conventional lower thread winding device and a detector of the above;

FIG. 4 is an explanatory view of the structure of FIG. 3;

FIG. 7 is a control flow chart of the control circuit.

DETAILED DESCRIPTION OF THE PREFERRED EMBODIMENTS

Figure 3:
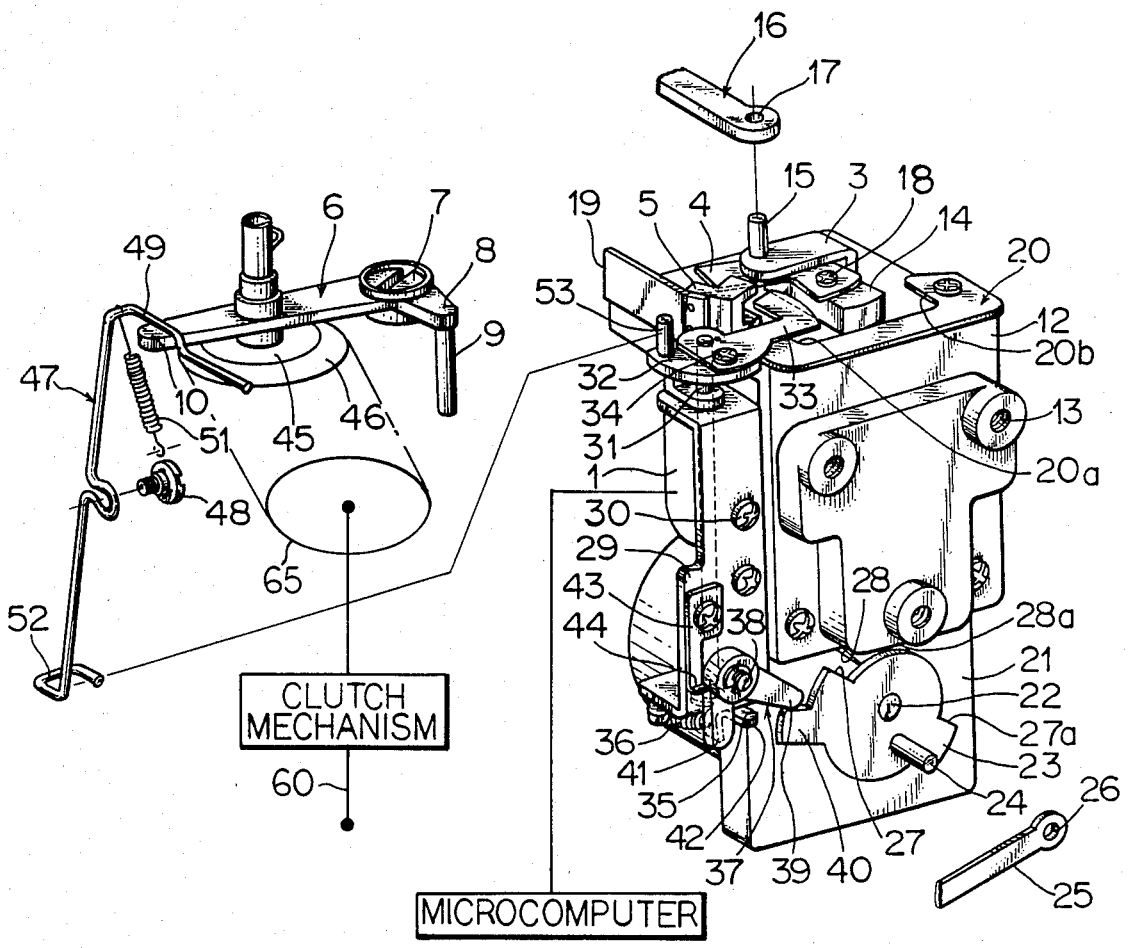
FIG. 3 is a perspective view showing an example of the invention.

In reference to FIGS. 1 and 2, the prior art arrangement will be explained in detail.

The sewing machine controls a pulse motor by an electric stitch control signal, and drives a stitch forming device. Since the pulse motor has a plurality of set positions with respect to energization of determined phases, a light interrupting plate 4 is fixed on, e.g., a shaft 2 of a needle swinging amplitude control pulse motor 1, as shown in FIG. 1, together with an amplitude arm 3 in order to provide one of said set positions. The pulse motor 1 is once rotated to a position where the plate 4 interrupts a photointerrupter 5. Then, an initial setting is made to a position in response to said energization with the controlling amount from said interrupting position. In other words, the sewing machine is provided with a position detector comprising a couple having the interrupting plate and the photointerrupter. When the fabric feed is controlled with another pulse motor, an initial setting should be made with a position detector comprising an interrupting plate and a photointerrupter, as mentioned above. While rotation of an upper shaft of the sewing machine is electrically observed and in case, when the sewing machine is abnormally stopped, this abnormal stopping continues more than a certain period of time and the electric current is broken to a machine motor. However, said stopping by accident should not be regarded as stopping of the upper shaft of the sewing machine for winding the lower thread while a beltwheel is rotating. Therefore, a safety circuit is provided to break the electric current to the motor. With respect to winding of the lower thread, a thread arm 6 is turnably furnished by a step screw 7 secured to the machine body as shown in FIG. 2, and the arm 6 is engaged at either of two turning points. A pin 9 at one end 8 of the arm 6 acts on a declutch mechanism (not shown) of the machine motor and the upper shaft of the sewing machine, and switches to a thread winding condition and to a thread releasing condition. The other end 10 actuates a microswitch 11 so that it is not directed to an order causing the safety circuit to interrupt the electric current to the machine motor that the upper shaft of the sewing machine is stopped at winding the thread. Thus, the thread winding part is provided with the microswitch 11 exclusively for the position detector. Since the prior art individually provides the detectors, disorder in one of them would influence on the entire body of the sewing machine, and there are problems about the cost of the detector, or distribution wire.

Now, the present invention will be referred to. The sewing machine which forms stitch patterns by the electric control signal, includes at least one pulse motor which forms the stitches of said stitch patterns, and respectively actuates a plurality of functions, such as the lower thread winding. The sewing machine is provided with the other actuating parts such as the thread winding arm or other pulse motors, an optical detector as the photointerrupter for detecting movement of the movable member. The moving member of the detector comprises individual or common interrupting plates which are moved in relation with the pulse motor or the lower thread winding arm, and interrupts or receives the light. The detector causes the interrupting plate to detect the moving member as far as the pulse motor moves beyond the movable range where the pulse motor is set for forming stitches. In respect to the control of the movements of the lower thread winding arm the detector has moving ranges of interrupting and recieving the light. In this control the pulse motor is set to an exceeding movable range, and the detected results of the detector do not respond to the control of that movement and therefore preference is made to the control. of the pulse motor. The pulse motor is controlled to the moving range beyond said set movable range in the determined rotation phase of the upper shaft of the sewing machine, and a control circuit is initially set from the detected result of the detector in order to control actuations of a plurality of the actuators by means of the common detector.

An embodiment of the invention will be explained with reference to the attached drawings. In FIGS. 3 and 4, the reference numerals 1 to 10 are the same or common members as in FIGS. 1 and 2 showing the prior art. A needle swinging amplitude control pulse motor 1 is held on a supporting bed 12 which is fixed to a machine body (not shown) via three screw portions 13. An arm 14 of the pulse motor is secured to a shaft thereof (not shown in FIG. 3 but the same as "2" in FIG. 1). The pulse motor arm 14 is fixed with an amplitude arm 3 which holds a pin 15, and the pin 15 plays in a hole 17 of an amplitude rod 16 which carries out lateral swinging amplitude of a needle rod (not shown). The interrupting plate 4 is secured to the pulse motor arm 14 with a screw 18. The photointerrupter 5, which is an optical detector, is connected to a plate 19 fixed to the pulse motor 1. When the pulse motor is rotated in the clockwise direction to a determined rotation phase in FIG. 3, the plate 4 interrupts the photointerrupter 5. The numeral 20 designates a stopper fixed to the arm 1 and the pulse motor 14 is engaged with engaging faces 20*a*, 20*b* to avoid overrunning of the arm 14. The numeral 21 is a pulse motor for controlling the fabric feed, which is provided to the supporting bed 12. A shaft 22 is fixedly mounted with a feed actuating arm 23, and a pin 24 implanted on the arm 23 plays in a hole 26 of a feed rod 25 which actuates the feed adjusting device (not shown). The feed actuating arm 23 is defined with engaging portions 27, 27*a* for contacting engaging faces 28, 28*a* defined on the suppporting bed 12 so that the feed actuating arm 23 is not overrun. The supporting bed 12 is fixed with a plate 29 on its side with two screws 30, and the plate 29 is equipped with a rotatable interrupting shaft 31. The shaft 31 is fixed with an interrupting bed 32 on its top, and the interrupting bed 32 is fixed with an interrupting plate 33 by a screw 34. When the shaft 31 is rotated in the counterclockwise direction in FIG. 3, the photointerrupter 5 is interrupted. The shaft 31 is fixed with an arm 35 of the interrupting shaft at its lower portion, and the arm 35 energizes the shaft 31 in the clockwise direction by means of a spring 36 connected to the plate 29. The numeral 37 is an interrupting arm which is rotatably mounted on a pin 38 fixed on the plate 29, and its other end 41 engages an end portion 42 of the arm 35, and the feed actuating arm 23 rotates in the clockwise direction to rotate the arm 35 in the clockwise direction against the spring and to position the interrupting plate 33 in the interrupting position of the photointerrupter 5 at the determined rotation. The other end 41 of the interrupting arm 37 contacts an engaging portion 44 of the feed interrupting stopper 43 fixed to the plate 29 of the interrupting shaft to prevent the rotation of the interrupting arm in the clockwise direction by energization by the spring 36. Therefore, if the feed actuating arm 23 is further rotated in the counterclockwise direction under said contacting condition, a projection 40 of the actuating arm 23 is released from the end 39 of the interrupting arm 37, and the actuating arm does not move the interrupting plate 33 under such condition. A thread winding arm 6 is turnably provided to the machine body by means of a step screw 7, and the arm 6 is operated to rotate in the counterclockwise direction in FIGS. 2 and 3; a rubber wheel 46 of a thread winding wheel engages on a belt wheel 65 of the upper shaft 60, and concurrently a pin 9 implanted on one end 8 of the thread winding arm 6 actuates a declutch mechanism to release connection of the belt wheel of the upper shaft and the upper shaft of the sewing machine (not shown), which are connected to the machine motor, and when the arm 6 is turned to the clockwise direction, it is stably engaged at a determined turning position. Then the thread winding wheel 45 is released and said connection is provided. The numeral 47 is a thread winding rod which is furnished to the machine body with a step screw 48. Rod 47 has a cam portion 49 positioned above the end 10 of the thread winding arm 6. The thread winding rod 47 is energized in the counterclockwise direction by a spring 51 mounted to the machine body 50. When the thread winding arm 6 is operated in the clockwise direction and releases the thread winding, the thread winding rod 47 is rotated in the clockwise direction as shown with the solid lines in FIG. 4 without contacting the cam portion 49 at an end 10 of the thread winding arm, and the cam 49 contacts the machine body 50. When the thread arm 6 is rotated in the counterclockwise direction and winds the thread, the cam portion 49 is pushed upward so that the thread winding rod 47 is rotated in the counterclockwise direction. The thread winding rod 47 is formed with a groove 52 for connecting with the interrupting plate 33. On the other hand, the interrupting arm 33 is provided with a pin 53, so that the interrupting plate 37 is engaged with the stopper 43. Under the condition that the thread winding rod 47 is released, the pin 53 is positioned in the groove 52 but does not contact the same. Under the thread winding condition shown with the two dotted lines, the pin 53 contacts the groove 52 and rotates the interrupting bed 32 in the counterclockwise direction in FIG. 3, thereby to make a relative position for interrupting the light of the photointerrupter 5.

Figure 5:
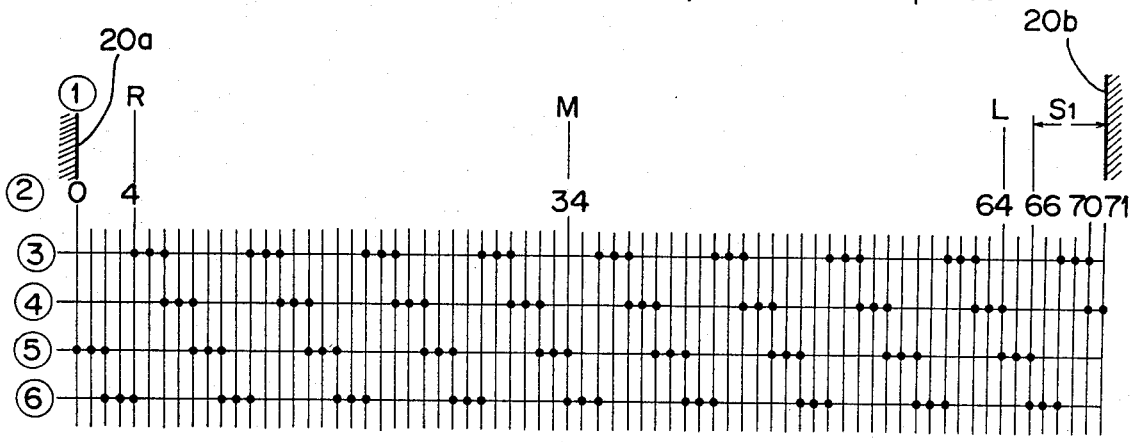
FIGS. 5 and 6 are explanatory views of the structure and actuation of the pulse motor.
Figure 6:
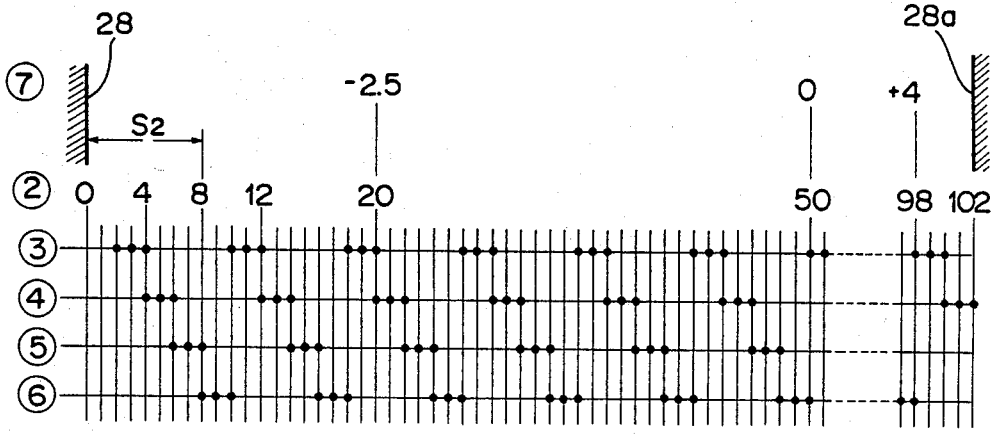

FIGS. 5 and 6 show respectively the pulse motors 1, 21 for controlling the needle amplitude and the fabric feed, and control systems thereof. By-polar 1–2 phase energization comprising A-phase, B-phase, $\overline{A}$-phase, $\overline{B}$-phase is employed.

FIG. 5 shows relation between the needle amplitude coordinate of the sewing machine and the energization phase of the pulse motor. "0–71" of the coordinate are the coordinate number at 71 divisions of the range where the needle of the sewing machine is movable. Needle dropping positions R, M, L are the right maximum, middle, and the left maximum corresponding to the coordinates 4, 34 and 64. The step of each of the coordinates responds by 1:1 to the step of the pulse motor 1. In FIG. 5, the needle dropping position R is marked on the left and L is marked on the right contrary to the movement of the needle. This is why if the pulse motor arm 14 is rotated, e.g., in the clockwise direction in FIG. 3 and contacts the engaging face 20*a* of the stopper 20, the amplitude rod 16 is moved to the left maximum and then the needle responds to the right maximum, that is, R. The coordinates 0–4 are ranges required to the initial setting with surplus, the coordinates 70–71 are surplus ranges, and the coordinates 66–71 shown with "S1" are ranges where the interrupting plate 4 interrupts the photointerrupter 5. With respect to circle marks in A-phase to $\overline{B}$-phase, in the control for causing the needle to respond to each number of the coordinate, when the sole phase is energized, the coordinate corresponding to the middle mark of the three circular marks responds thereto, and when the two phases having the marks in common are energized, the coordinates having the circular marks in common respond thereto. That is to say, if A phase and B phase, for example, arre energized, they are controlled to any one of the plural coordinates 6, 14 . . . 70.

FIG. 6 shows relation between the pulse motor 21 and the amount of designating the fabric feed (which is shown in coordinate as controlling the positions of the fabric feed adjuster in accordance with FIG. 5). "0–102" of the coordinate are the coordinate number at 102 divisions of the range where the fabric feed is controllable. The feed amounts −2.5, 0, +4 (mm) are the maximum backward feed, the feed 0 and the forward feed. The step of each of the coordinates responds by 1:1 to the step of the pulse motor 21.

In FIG. 6, the progressing direction to the right of the coordinate as 0, 1, 2, . . . corresponds to the rotation in the clockwise direction of the interrupting plate 33, the coordinates 4–20 are ranges required to the initial setting with surplus, and the coordinates 98–102 are surplus ranges. The control circuit for controlling the pulse motors 1, 21 uses mainly microcomputer. As shown in detail in later flow chart, when the winding of the lower thread is designated, the initial setting is each provided in said range in response to the rotation phase of the upper shaft of the sewing machine with respect to each of the pulse motors in preference to driving of the pulse motors 1, 21 without obstructing the function of winding the lower thread. That is, since the position to be set in the energization of the specific phase has a plurality of the unspecific coordinates, the initial setting is made any one of the unspecific coordinates.

The present invention has the above mentioned structure, and the actuation will be explained in reference to the flow chart in FIG. 7. When the controlling power source is supplied, the program control is started in the main of the microcomputer. The pulse motors 1, 21 are energized at A-phase and B-phase in FIG. 5. For control as later mentioned, flags B, F, T, G are each made 0, and the pattern selecting keys are read out. Discrimination is made whether or not the photointerrupter 5 is interrupted by the interrupting plate 4 or 33, and if not interrupted, discrimination is made whether or not the upper shaft of the sewing machine is at the determined phase of the amplitude control in T=0 and G=0 as to each of the flags in order to provide the initially setting control of the pulse motors 1 and 21. If the photointerrupter 5 is interrupted, the flags T and G are not altered. Being not the amplitude phase, the program goes to ②, but assuming the amplitude phase, the program returns to ①, if flag T=1. Since T is 0 initially and B is 0 in the next process, the photointerrupter 5 is discriminated in interruption or it is not. The flag B=0 shows that the initial setting of the amplitude controlling pulse motor 1 is not completed. Apart from the abnormal case, the pulse motor causes the interrupting plate 3 to receive the light of the photointerrupter 5. That is, if the interrupting plate is at any one of 6, 14 . . . 62, the pulse motor is moved 8 steps in the counterclockwise direction, i.e., in the increasing of the coordinate number. Consequently, the movement of 8 steps is repeated until the photointerrupter 5 reaches up to the coordinate 70 in the interrupting range S1, and when the photointerrupter reaches 70, the control circuit stores 70 as an initial setting value of the amplitude coordinate, and the machine motor is designated to the high speed rotation and the flag B is 1 for showing completion of the initial setting. If the photointerupter 5 is initially interrupted and the pulse motor 1 is at the coordinate 70, the pulse motor is moved 8 steps in the clockwise direction, and when it makes the light receiving condition, the control circuit stores "62" as the initial setting value. As a result of the movement in the clockwise direction, if the photointerrupter is still at the light receiving condition, it is interrupted by the interrupting plate 33. This fact means that the pulse motor 21 does not interrupt the light at the initial stage but depends upon the winding of the thread winding arm 6. In this case, the machine motor is designated to the low speed rotation for meeting the thread winding. The flag B is made 0. Subsequently, the flag T is made 1 in order not to repeat said control by completion of the thread winding control and the initial setting. The discrimination is made whether or not the flag B is 1, and since B is 0 at designating the thread winding, the program returns to ①. The photointerrupter 5 continuously interrupts the light, and since the upper shaft of the sewing machine does not rotate, the amplitude phase continues. Since T is 1, the program returns to the returning point ①, the thread is continuously wound without altering the flags. If the pulse motor 1 is initially set at the amplitude coordinate 62 or 70 without designation of the thread winding, the pulse motor is driven in reference to these coordinates for the amplitude control. In this case, the coordinate for the needle amplitude is designated to any of 4 to 64. When the sewing machine is rotated to the feed controlling phase, and since the flags G and F are both 0, the pulse motor 21 for the fabric feed control is initially set similarly as the pulse motor 1, or when the thread winding arm 6 is operated in the feed phase, the thread winding is controlled. The initial setting value of the pulse motor 21 is, in reference to FIG. 6, the coordinate 4 by the energizations of A, B phases within the interrupting range S2, or the adjacent coordinate 12 by the same energizations. The flags G and F respond to the flags T, B and have the same function. When the initial setting of the pulse motor 21 is finished without designation of the thread winding, the flag F is 1, so that the pulse motor is driven in reference to the coordinate 4 or 12 and the fabric feed is controlled. Referring to FIG. 6, the coordinate for the fabric feed is designated to any of 20–98, and the program returns to ①. If the thread winding is not designated, the photointerrupter 5 is ready for receiving the light, and the flag T is 0 and the flag G is 0. At the amplitude control phase, the pulse motor 1 controls the amplitude, and at the fabric feed control phase, the pulse motor 21 controls the fabric feed, and the program returns to ① to control the stitches.

Depending upon the present invention, one detector serves, for example, for detections of the initial settings of the two pulse motors and the designation of the lower thread winding, and the detectors and wirings may be made simple. Also the mechanical connection for displaying the functions thereof may be made relatively simple.

What is claimed is:

1. In a sewing machine comprising stitch forming instrumentalities, a needle swinging device and a fabric feed regulator, a motor-driven belt wheel, a drive shaft arranged in the sewing machine, clutch means interconnected between the belt wheel and the drive shaft and operated in one direction to connect the belt wheel to the drive shaft and in the opposite direction to disconnect the belt wheel from the drive shaft; at least two pulse motors (1, 21) each having a control shaft and operatively connected to the needle swinging device and the fabric feed regulator, respectively to control the stitch forming instrumentalities; and microcomputer means operated in accordance with a predetermined program to control the pulse motors, an improvement comprising a first screening element (4) and a second screening element (33) each operated in association with the respective control shaft of the two pulse motors (1, 21); and a single photoelectric sensor means (5) adapted to cooperate with said first screening element and said second screening element at predetermined anngular positions taken by the respective control shafts of the respective pulse motors to thereby produce a plurality of electric signals for operating the microcomputer means to set each of the pulse motors to an initial position.

2. The sewing machine as defined in claim 1, further including means for connecting said second screening element to the control shaft of the associated pulse motor, which include a feed actuating arm (23) mounted on the control shaft (22) of the associated pulse motor, an interrupting arm (37) actuated by said feed actuating arm, and a turnable interrupting shaft (31) having an arm (35) cooperating with said interrupting arm, said interrupting shaft being connected to said second screening element (33) to position said second screening element into its interrupting position with respect to said single photoelectric sensor means (5).

3. The sewing machine as defined in claim 2, further comprising a bobbin thread winding device including turnable thread-winding actuating means (6), rotational means (46) connected to said actuating means and engageable with the belt wheel of the sewing machine, and declutching means (9) connected to said actuating means and engageable with the clutch means of the sewing machine; said actuating means, said rotational means and said declutching means being movable in association with each other, said actuating means (6) being movable between an inoperative position in which said rotational means (46) is spaced from the belt wheel and said declutching means (9) is spaced from the clutch means and an operative position in which said rotational means (46) engages the belt wheel and said declutching means (9) operates the clutch means to disconnect the belt wheel from the drive shaft, said actuating means (6) in said operative position being operatively connected to one of said first and second screening elements (4, 33) to move the respective screening element to a position in which said screening element cooperates with said single photoelectric sensor means (5) to produce an electric signal of starting a bobbin thread-winding operation to the microcomputer means.

4. The sewing machine as defined in claim 3, further including means for connecting said actuating means (6) to said second screening element, which include a thread winding angular rod (47) having one end engageable with said second screening element (33) and another end engageable with said actuating means (6).

* * * * *